US008894503B2

(12) United States Patent
Dandrea

(10) Patent No.: US 8,894,503 B2
(45) Date of Patent: Nov. 25, 2014

(54) GOLF SWING TRAINING AID

(75) Inventor: John Dandrea, Marlton, NJ (US)

(73) Assignee: Simple Golfing Solutions LLC, West Berlin, NJ (US)

( * ) Notice: Subject to any disclaimer, the term of this patent is extended or adjusted under 35 U.S.C. 154(b) by 146 days.

(21) Appl. No.: 13/573,181

(22) Filed: Aug. 28, 2012

(65) Prior Publication Data

US 2014/0066220 A1 Mar. 6, 2014

(51) Int. Cl.
*A63B 69/36* (2006.01)

(52) U.S. Cl.
USPC ..... 473/226; 473/227; 473/276

(58) Field of Classification Search
CPC . A63B 69/36; A63B 69/3632; A63B 69/3641
USPC ..... 473/201, 226, 227, 228, 212, 213, 276
See application file for complete search history.

(56) References Cited

U.S. PATENT DOCUMENTS 1,990,281 A * 2/1935 Grelle ..... 473/232
3,070,370 A * 12/1962 Steiner ..... 473/295
3,954,271 A * 5/1976 Tredway, Sr. ..... 473/212
4,145,054 A * 3/1979 Stewart ..... 473/227
5,009,426 A * 4/1991 Cox ..... 473/227
5,294,126 A * 3/1994 Armstrong, III ..... 473/227
5,846,143 A * 12/1998 Brock et al. ..... 473/409
5,851,156 A * 12/1998 Schwark, Jr. ..... 473/201
6,251,025 B1 * 6/2001 Brock et al. ..... 473/227
6,558,302 B2 * 5/2003 Cluff ..... 482/129

* cited by examiner

*Primary Examiner* — Sebastiano Passaniti
(74) *Attorney, Agent, or Firm* — Armand M. Vozzo, Jr.

(57) ABSTRACT

A golf swing training aid intended for practice use by a golfer as a removable attachment to a standard golf club. The training aid comprises a specially adapted clamp assembly for releasable attachment to the grip of the golf club, a handle member projecting rearward from the clamp assembly, and a bowed guide arm member extending forwardly from the clamp assembly and further engaging the grip so that the guide arm projects between the forearms of the golfer when his hands are positioned normally upon the grip. The clamp assembly comprises a deployable crown assembly of flexible finger members mounted in a radial configuration and fitted to move into and from within a collar housing in such a fashion as to selectively engage and release the grip end of the golf club.

17 Claims, 8 Drawing Sheets

GOLF SWING TRAINING AID

BACKGROUND OF THE INVENTION

The present invention relates generally to training devices used by golfers to improve their performance on the golf course, and more particularly to an improved golf swing training aid that incorporates specially adapted clamp assembly for attaching to the grip end of a standard golf club with a handle member projecting rearward therefrom and a bowed guide arm extending forwardly so that the guide arm may project between the forearms of the golfer and be maintained in contact with the leading forearm during all stages of the practice swing to train the golfer in making a proper takeaway in his backswing and encourage proper hinging and unhinging of the lead wrist throughout the swing.

In recent times, the game of golf has experienced a significant growth in popularity and participation, there now being over 50 million golfers indicated worldwide, with over half of those being in the United States. Men and women, young and old alike have become golf participants and frequent players, all for the most part having a common desire to improve their game and level of play. Regardless of whether the golfer is a novice beginner or an experienced player, improvement in game-playing performance is generally sought through practice and the use of training aids both on and off the course. Golf swing training aids are practice devices designed to improve a particular aspect of the golf swing. They take a variety of forms including modified golf clubs, appliances that manipulate and/or guide the swing path, and tools that provide help in aligning the golfer to best direct the shot at the target. While the rules of golf prohibit such swing training aids to be used in actual play, their repetitive use in practice can effectively engrain the golfer with "muscle memory" or motor learning of the complex movements of muscles and joints employed in a full golf swing so that the golfer may more consistently generate an optimal form of swing execution in actual play without conscious effort. By proper design and use of these golf swing aids in training, the muscle memory developed will better able the golfer to execute the proper sequence and timing of the movements of those muscles and joints involved in the swing and to coordinate their movements for improved game performance on the course.

A desirable feature of any golf swing training aid and one that is important in developing the correct muscle memory in the golfer is the element of immediate feedback that the training aid provides the golfer while using it in practice. While practicing the golf swing, it can be difficult for the golfer to determine if he or she is performing correctly based solely on the feel of the swing. An effective swing training aid should therefore give the golfer a recognizable and immediate element of feedback, positive or negative, with every practice swing and throughout the various stages of the swing in order to develop and establish the proper muscle memory associated with a fundamentally correct swing of the hands and arms: one in which the forearms of the golfer, driven by a turning motion of the shoulders in a so-called "one-piece" takeaway, rotate gradually away from the ball at address while the wrists hinge upward into a cocked position about 90° relative to the respective forearms through the backswing, keeping the leading arm relatively straight as possible through the takeaway and the trailing arm being folded with the elbow tucked behind through the top of the backswing; then from the top of the backswing where the leading wrist is in a "flat" position with the back of the hand being in alignment with the forearm, the shoulders begin to turn back and initiate a reverse downward movement of the wrists and arms with the trailing arm unfolding and straightening as the hands and arms move through impact with the ball, where the wrists unhinge together and release just prior to impact with the leading wrist maintained in the "flat" position through the impact position. Key movements of the swing commonly recognized as essential to solid and consistent shot-making are the proper takeaway from the address position, the proper hinging of the wrists in the backswing and their unhinging in the downswing just prior to impact, with the "flat" leading wrist position, essentially set in the takeaway, being maintained at the top of the backswing and down through impact position. Through practice routines, particularly guided by a well-designed swing teaching aid, a golfer can effectively train himself through feedback and muscle memory to adopt these key swing movements correctly and in proper sequence and thereby improve his performance in actual play.

Various forms of prior art golf teaching devices have been devised and developed, some designed to train the golfer in a particular aspect of shot making, such as putting and chipping, and others intended to train the golfer in better adopting and executing the fundamentals of the full swing. In that latter group of prior art full swing training devices, a substantial number are tools or appliances that are specially configured and made to attach to the golf club shaft in such a way as to interact with the golfer's wrists and arms during the swing as a guide for training their proper movement and positioning. Examples of these are found shown and described in U.S. Pat. No. 4,023,812 to Lorang; U.S. Pat. No. 4,145,054 to Stewart; U.S. Pat. No. 5,009,426 to Cox; U.S. Pat. No. 5,294,126 to Armstrong III; U.S. Pat. No. 5,846,143 to Brock et al.; and U.S. Pat. No. 6,881,155 to Rohan-Weaver. While these and other prior art shaft-attachable golf swing training aids have generally performed satisfactorily when initially secured in place for practice use, their attachments are somewhat burdensome and difficult to set, and during extended usage and the repeated swing motions of the golfer, tend to loosen and move out of place, misaligning the guide elements of the aid and altering, if not eliminating their intended interaction with the golfer's wrists and arms during further practice. In addition, these and like shaft-attachable training aids found in the prior art have lacked a guidance feature most important for training the golfer to execute the proper takeaway as a vital stage of the full swing. Accordingly, there is a need for an improved golf swing training aid that will overcome these and other shortcomings in the prior art and better train the golfer in correctly executing the full swing.

SUMMARY OF THE INVENTION

Accordingly, it is a general purpose and object of the present invention to provide an improved golf swing training aid capable of enhancing the playing performance of golfers of all sorts through practice usage.

A more particular object of the present invention is to provide a golf swing training aid capable of attachment to any golf club, be it right-handed or left-handed, and usable in practice by a golfer, male or female, without restricting or interfering with his or her swing motion to teach proper swing movements of the hands and arms and correct positioning of the wrists during execution of a full swing.

Another object of the present invention is to provide an improved golf swing training aid for practice use by right-handed and left-handed golfers alike that is readily attachable to the golf club and capable of remaining firmly positioned in proper placement thereon during extended practice and repeated swing usage.

Still another object of the present invention is to provide an improved golf swing training aid that provides immediate feedback to the golfer during practice usage and develops muscle memory therefrom in order to promote a correct takeaway and proper hinging and unhinging of the wrists throughout the swing.

A still further object of the present invention is to provide an improved golf swing practice aid to train the golfer to maintain the flat position of the leading wrist and forearm at the top of the backswing and down through impact and prevent unnecessary cupping or bowing of the lead wrist.

Yet another object is to provide an improved golf swing training aid that is lightweight yet durable in its construction, simple in its assembly and attachment, and capable of effective use at home as well as on the practice range by all golfers regardless of their skill level.

Briefly, these and other objects of the present invention are accomplished by a golf swing training aid intended for practice use by a golfer as a removable attachment to a standard golf club. The training aid comprises a specially adapted clamp assembly for releasable attachment to the grip of the golf club, a handle member projecting rearward from the clamp assembly, and a bowed guide arm extending forwardly from the clamp assembly and further engaging the grip so that the guide arm projects between the forearms of the golfer when his hands are positioned normally upon the grip. The clamp assembly comprises a deployable crown assembly of flexible finger members mounted in a radial configuration and fitted to move within a collar housing in such a fashion as to selectively engage and release the grip end of the golf club. With the training aid clamped in place on the golf club, the golfer freely executes practice swings with the handle member pointing directly at the golfer's belt buckle at address and during the takeaway and with the guide arm being maintained in contact with the leading forearm during all stages of the practice swing to train the golfer in making a proper takeaway and encourage proper hinging and unhinging of the lead wrist throughout the swing.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

Figure 1:
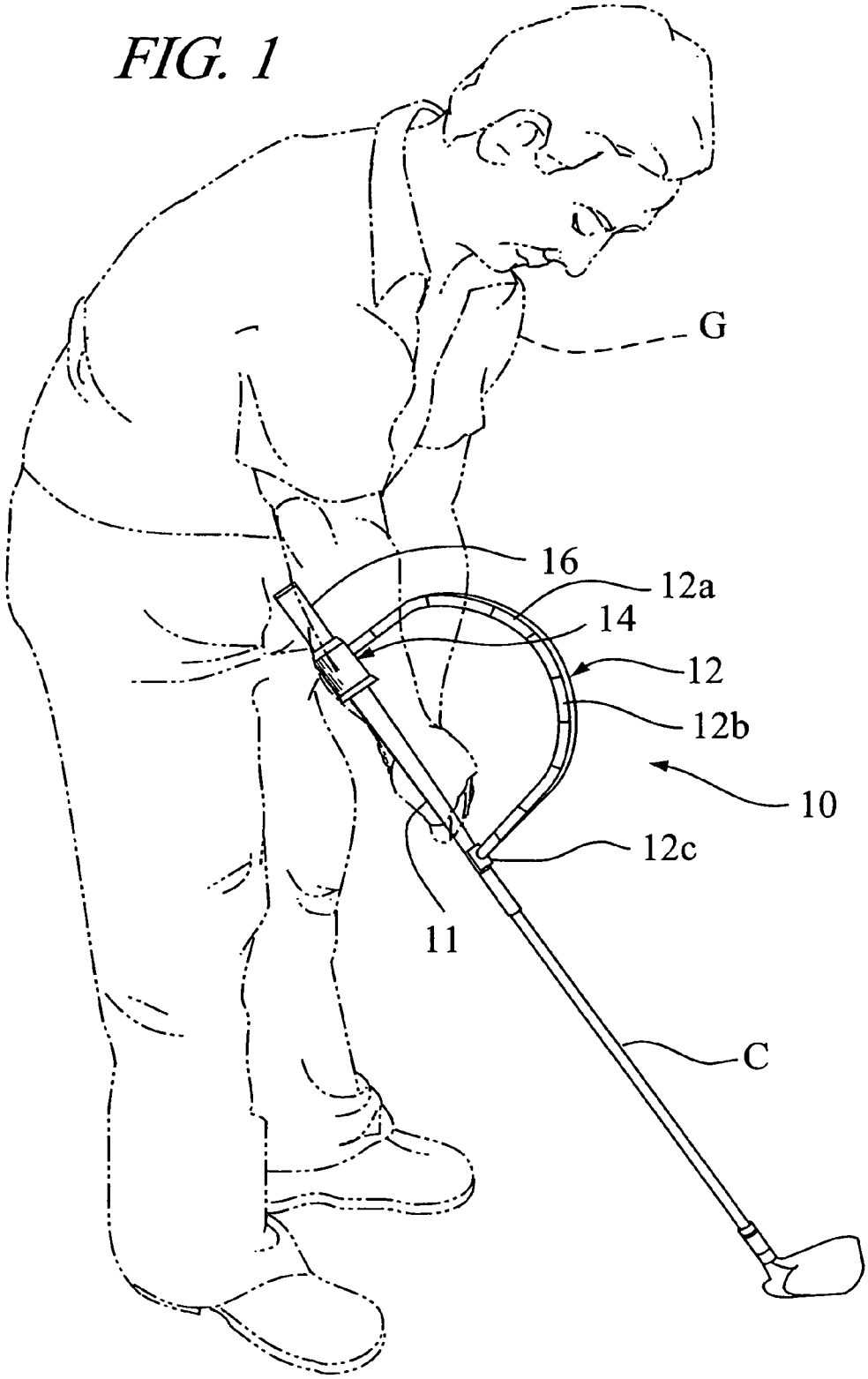
FIG. 1 is a perspective view of a golfer shown in phantom outline holding a golf club in an address position that is equipped with a golf swing training aid made in accordance with the present invention.

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to appended claims.

Referring to the drawings, the following is a list of structural components of the present golf swing training aid, generally designated 10, and those associated structural elements shown employed in connection with the present invention:

10 golf swing training aid;
11 golf club grip;
12 guide arm;
12*a* U-shaped frame;
12*b* side slots;
12*c* end clip;
14 clamp assembly;
16 handle member;
18 handle cover;
20 collar housing;
22 collar plate;
24 crown assembly;
26 crown fingers;
26*a* finger head;
26*b* finger stem;
28 finger holder;
29 crown base;
30 crown guide;
32 crown rod;
G golfer; and
C golf club.

Figure 3:
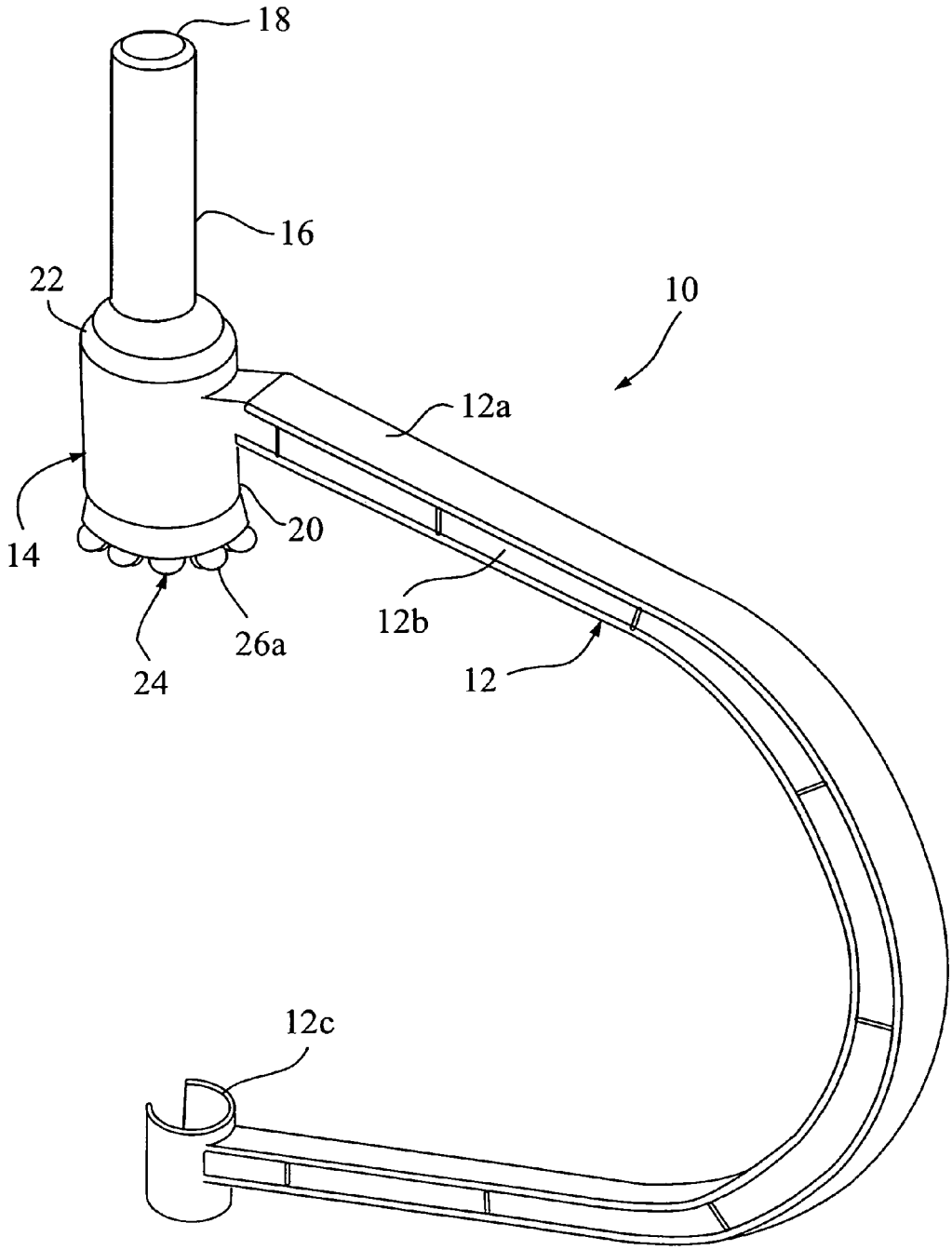
FIG. 3 is a perspective view of the present golf swing training aid removed from its mounted attachment to the golf club shown in FIGS. 1 and 2.

Referring initially to FIG. 1, the present golf swing training aid 10 is shown in its intended attachment to a traditional golf club C with the structure of the training aid being engaged upon the golf club grip 11 in such a way that allows the golfer G to hold the club freely with both hands in the grip position suitable to effectuate a full swing of the golf club. In accordance with the present invention, the golf swing training aid 10 comprises a guide arm member 12 that is bowed in its configuration and connected at one end thereof to a clamp assembly 14 designed and constructed in its assembly to releasably engage the butt end of the golf club C along the longitudinal axis thereof and about the upper end of the grip 11. A handle member 16 having a cylindrical form is coupled to the clamp assembly 14 and made to extend rearwardly therefrom in an axial direction that is substantially aligned with that of the golf club C when fully engaged by the clamp assembly. The guide arm 12 comprises a U-shaped frame member 12*a* constructed having a series of slots 12*b* formed along the length of the frame member on opposite sides thereof between top and bottom surfaces that are substantially flat and parallel. This form of construction of the guide arm 12, better seen in FIG. 3, provides a firm but lightweight structure for the intended use of the present golf swing training aid 10 as a mounted attachment to the golf club C. The guide arm 12 is further provided with an end clip 12*c*, better seen in FIGS. 4 and 4*a*, that is secured at the opposite end of the U-shaped frame member 12*a* distal to the clamp assembly 14 and handle 16 to engage the lower end of the golf club grip 11 and further secure the intended mounted attachment of the present golf swing training aid 10 for operational use. In this intended mounted attachment of the golf swing training aid 10, the bowed guide arm 12 secured at the top golf club grip 11 by means of clamp assembly 14 extends forwardly therefrom along the longitudinal axis of the golf club C and is secured to the lower end of the grip by means of end clip 12*c* so that the guide arm projects between the forearms of the golfer G when his hands are positioned normally upon the grip and will be maintained in such position throughout a full practice swing.

Figure 2:
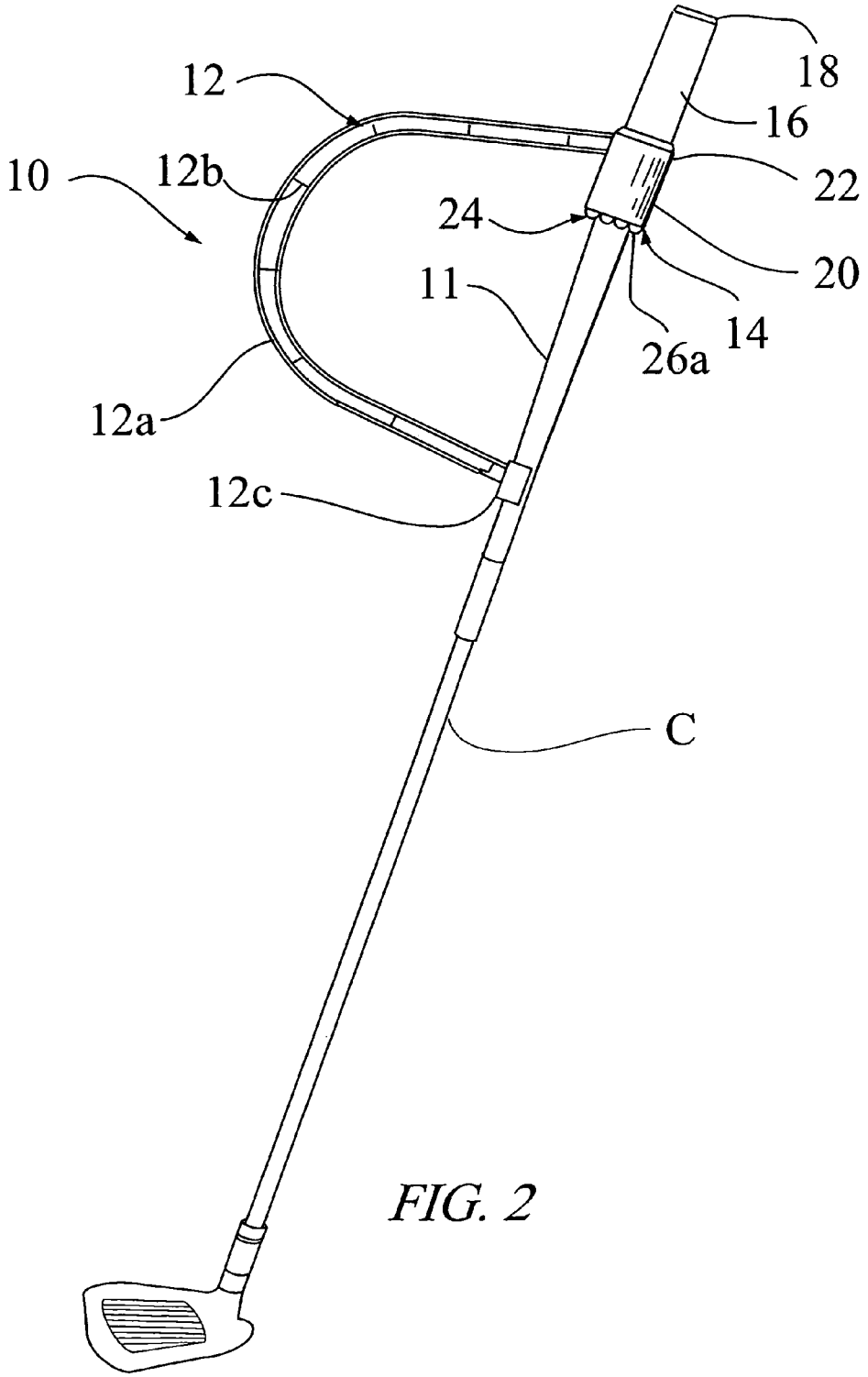
FIG. 2 is a view in elevation of the golf club shown separate from the golfer in FIG. 1 and from the opposite perspective with the present golf swing training aid in mounted attachment.
Figures 4, 4A, 4B:
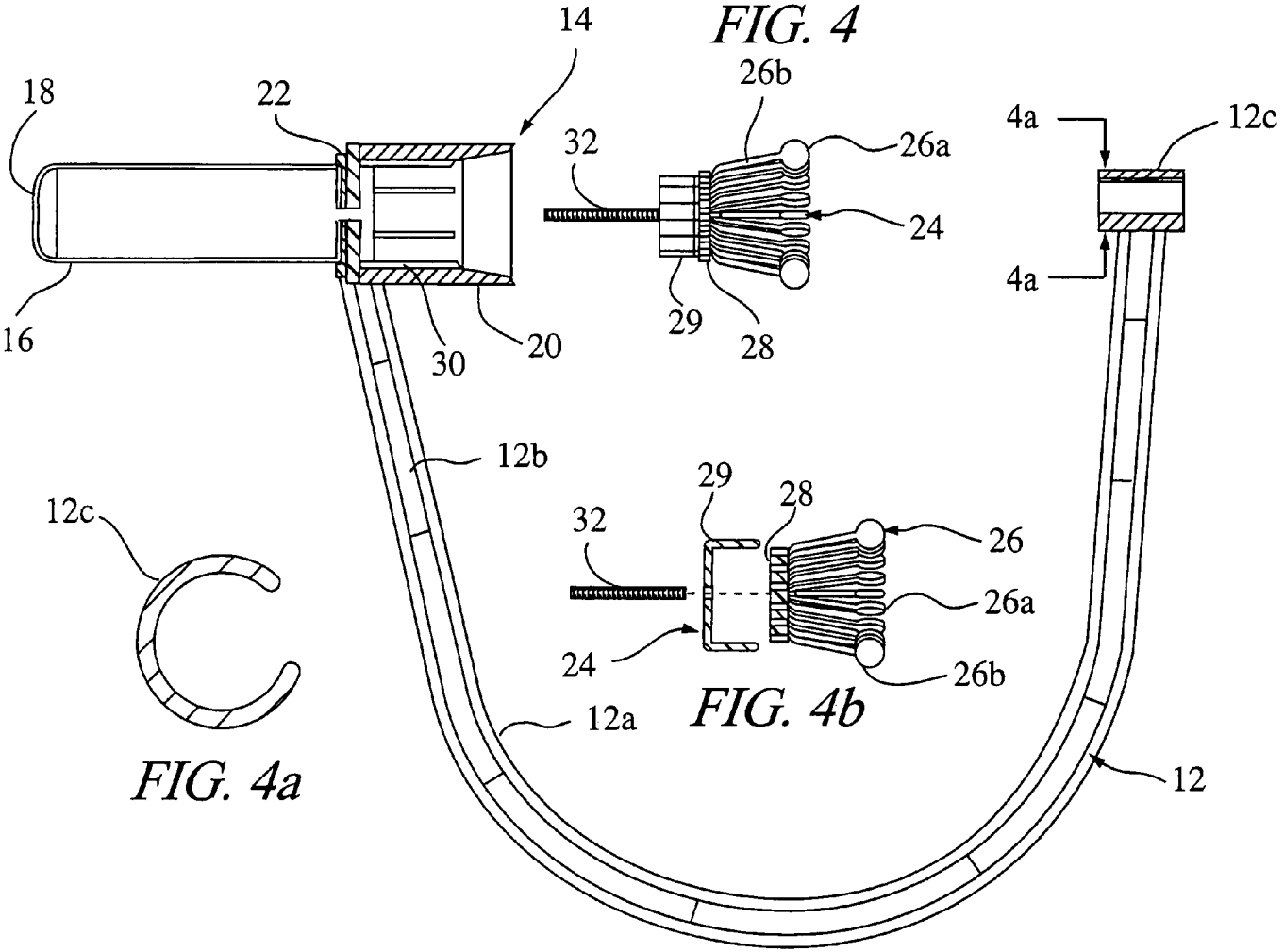
FIG. 4 is a side elevation of the golf swing training aid of FIG. 3 partially sectioned along the clamping axis intended for mounted attachment to the golf club with an associated crown assembly used for clamping being shown withdrawn in a separated position along the axis.
FIG. 4*a* is a cross-sectional view of the present golf swing training aid taken along the line 4*a*-4*a* in FIG. 4.
FIG. 4*b* is an exploded longitudinal view detailing the crown assembly shown in FIG. 4.

Referring now to FIGS. 2-4 in conjunction with FIG. 1, all of the structural components of the present golf swing training aid 10 are made from material that is strong and durable, such as a plastic, and are fabricated and assembled so as to provide a lightweight overall structure to the training aid and minimize the weight added thereby as an attachment to the golf club C. The handle member 16 is a cylindrical member with a fixed length, typically between about 3-4 inches, further having a chamber intended to accommodate the movement of working elements of the clamp assembly 14 as described below in greater detail. The handle member 16 is disposed in axial alignment with the clamp assembly 14, the front end of the handle member being coupled to the rearward surface of the clamp assembly, preferably via a collar plate 22 disposed coaxially at the back end of collar housing 20. The collar plate 22 has a central axial opening therethrough that allows the connector rod 32 of the crown assembly 24, more fully detailed below, to pass freely into the handle 16 during operation of the clamp assembly 14, with the collar plate being further capable of selectively locking and releasing the position of the connector rod through a twisting motion imparted by the handle. A handle cover 18 generally circular in form and sufficiently sized to fit the rearward end of the handle 16 is used to close the chamber thereof. In addition to being the preferred means for handling the present golf swing training aid 10, particularly when unattached and separated from the golf club C, the handle member 16 serves as an important visual aid to the golfer G when the training aid is attached for practice use, particularly at the address position and during the initial takeaway of the golf club, as described below in greater detail in references to FIGS. 1 and 6*a*. It should be noted and understood therefore that the handle member 16 and its associated cover 18 may be finished in a color contrasting to the remaining structure of the golf swing training aid 10 or in some other visually distinctive fashion to bring greater attention to its position at address and during the takeaway.

In further accordance with the present invention, the clamp assembly 14 includes a collar housing 20 that is cylindrical-like in its form with an open end and a specially fitted chamber and a deployable crown assembly 24 comprising a plurality of flexible finger members 26 disposed and assembled together in a radial arrangement that is adapted to move back and forth in an axial direction within the chamber of the collar housing to collectively "open" and "close" the assembled finger members. Best seen in FIGS. 4 and 4*b*, the finger members 26 are made in a flexible form each having a rounded head 26*a* at the top and a stem section 26*b* extending longitudinally beneath the head to the base of each finger member. A holder 28 for the finger members 26 is radially formed and configured with a number of slots symmetrically positioned around its perimeter. The number of slots in the finger holder 28 corresponds in number to the number of finger members 26 in the crown assembly 24, with each slot being sized and fitted to engage the base of a respective one of the finger members. When engaged and assembled in the finger holder 28, the radial arrangement of finger members 26 is normally flared slightly outward, as it appears in FIGS. 4 and 4*b*. A base member 29 is formed and fitted to closely surround the perimeter of the finger holder 28 with the finger members 26 engaged and assembled thereon. The finger holder 28 and base member 29 are each further formed with a similarly sized and threaded central hole through each that together align when assembled for mutual engagement and connection using an elongated connector rod 32 provided with corresponding external threads to thereby hold the crown assembly 24 together as a unit.

The crown assembly 24 is intended to axially engage the collar housing 20 and move axially in cooperation with its chamber to selectively close and open the radial arrangement of finger members 26 about the butt end of the golf club grip 11. The open end of the collar housing 20 is sized having sufficient diameter to accept entry of the crown assembly 24 with its connector rod 32 leading and the flared radial arrangement of finger members 26 trailing into the chamber of the collar housing. The chamber of the collar housing 20 is formed with an inward taper from the open end of the housing providing a narrowing chamber diameter that interacts with and presses about the flared arrangement of finger members 26 as it further enters the housing. This interaction between the chamber of the collar housing 20 and the radial arrangement of finger members 26 tends to close the arrangement of finger members as the crown assembly 24 moves inward of the chamber and in reverse, tends to open the finger arrangement as the crown assembly moves outward of housing chamber. A central hole or opening at the rear of the collar housing 20 is sized to permit passage of the connector rod 32 therethrough and into the handle member 16 through the collar plate 22 as the crown assembly 24 moves back and forth within the collar housing. The chamber of the collar housing 20 is further formed and fitted with a plurality of guide elements 30 along the chamber walls, the number of these guide elements corresponding to the number of finger member 26*s* radially arranged in the crown assembly 24. The guide elements 30 are positioned to align with and fit the spacing between each finger member 26 in the radial arrangement and serve together to center and maintain the axial movement of the crown assembly 24 through the collar housing 20 without twisting.

The end clip 12*c* is secured upon the end of the U-shaped frame 12*a* opposite from the clamp assembly 14 and its associated handle member 16. The end clip 12*c* is a substantially C-shaped member, as best seen in FIG. 4*a*, and is centered substantially along the same longitudinal axis as that of the clamp assembly 14 and handle 16 in a position to engage the lower part of the golf club grip 11 without stressing or distorting the U-shaped frame therebetween. The end clip 12*c* is firm but flexible in its structure and made having a sufficient radius and opening in its form so as to be able to fit over and upon the lower part of the golf club grip 11, holding the lower grip firmly therein and maintaining the projected position of the guide arm 12 between the forearms of the golfer G while the present training aid 10 is in mounted attachment and use upon the golf club C. While the opening formed in the end clip 12*c* is preferably directed to face 180° away from the U-shaped frame 12*a* for ease of engagement upon the golf club grip 11, the position of the opening may be made to face either side and still effectively work to engage and hold the grip firmly with the guide arm 12 in proper position for practice use of the present golf swing training aid 10.

Figure 5:
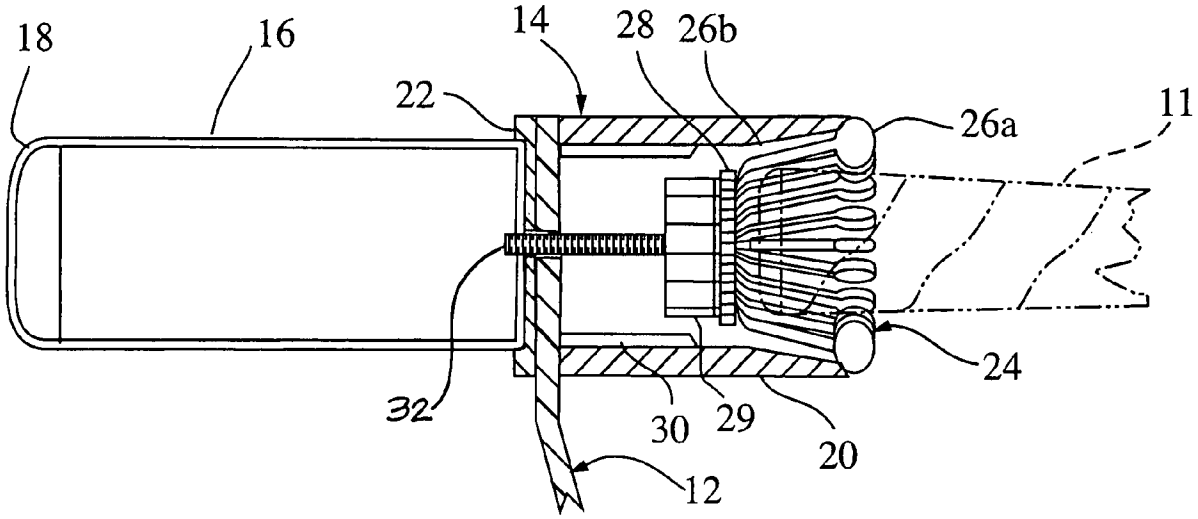
FIG. 5 is a cross-sectional side view of the clamp assembly of the present golf swing training aid shown with its associated crown assembly in an "open" operative position intended to accept an engagement or a release of the grip end of the golf club (in phantom)
Figure 5A:
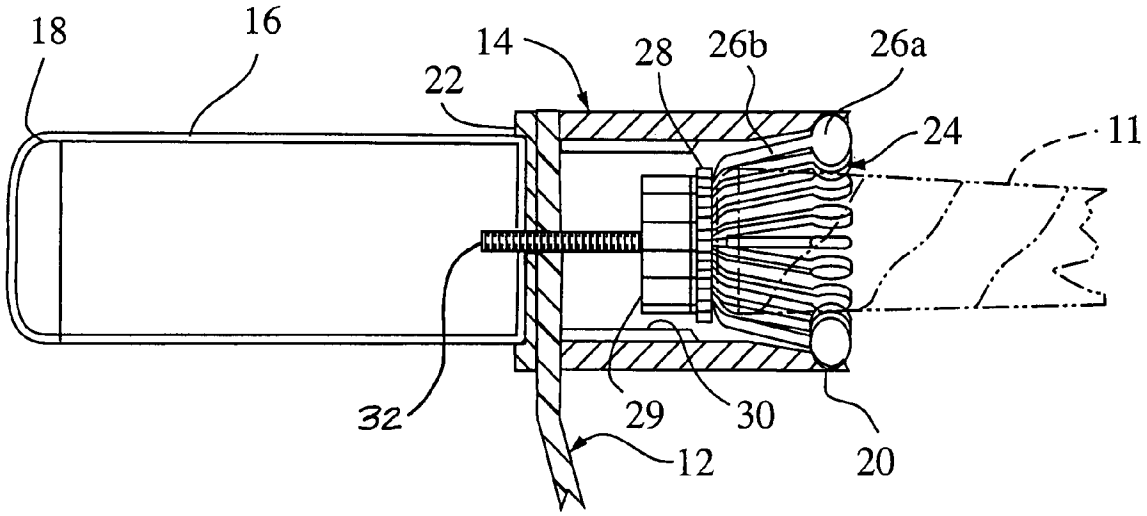
FIG. 5*a* is a cross-sectional side view of the clamp assembly shown with the crown assembly in a "closed" operative position intended to clamp the grip end of the golf club securely for practice use.

Referring now to FIGS. 5 and 5*a* in conjunction with FIG. 4, the clamp assembly 14 functions through its main operative components, namely, the crown assembly 24 and collar housing 20, to initially grasp the butt end of the golf club grip 11 when inserted into the open end of the collar housing, further centering the grip within the "open" radial arrangement of finger members 26 in the crown assembly. As seen in FIG. 5, the rounded heads 26*a* of the finger members 26 protrude slightly from the chamber of the collar housing 20 to accept insertion of the golf club grip 11 with the remaining elements of the crown assembly 24 disposed within the collar housing and the connector rod 32 extending through the chamber of the collar housing and into the handle member 16 via the collar plate 22. As the butt end of the golf club grip 11 is more fully inserted and seated within the radial arrangement of finger members 26, as seen in FIG. 5*a*, the entire crown assembly 24 including the rounded head sections 26*a* of the respective finger members 26 is moved rearward and guided through the collar housing 20 with the connector rod 32 extending deeper into the handle member 16. As a result, the head sections 26*a* of the respective finger members 26 are urged inwardly in their respective radial positions and into the "closed" position through interaction with the chamber of the collar housing 20 and thereby made to clamp the butt end of the grip 11 within the collar housing. In this clamped position, the connector rod 32 may be locked in place to hold the crown assembly 24 firmly in position within the collar housing 20 and around the butt end of the golf club grip 11.

Figure 6B:
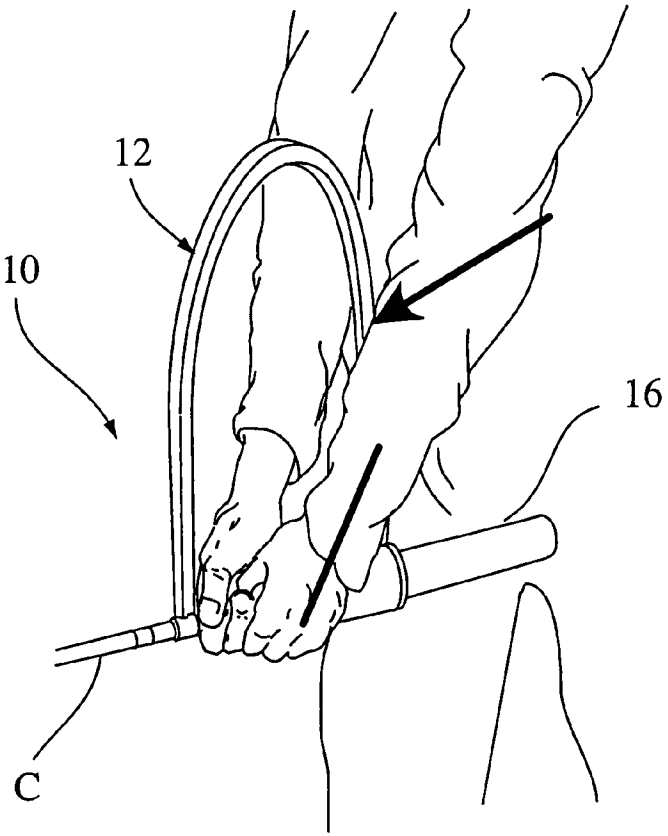
FIGS. 6*a*-6*f* are a series of views illustrating the manner of use of the present golf swing training aid and the respective positioning of the associated guide arm against the lead forearm at sequential stages of the swing that operates to train the golfer in their proper execution.
Figure 6A:
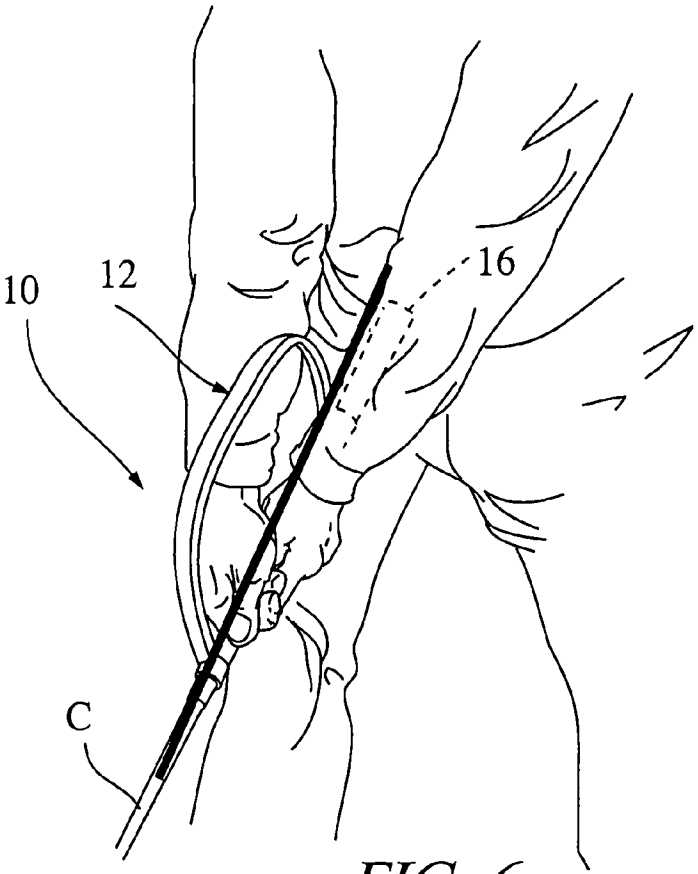

Referring now to FIGS. 6*a*-6*f* in conjunction FIG. 1, the proper operational use of the present golf swing training aid 10 set in mounted attachment upon golf club C can be described. In the proper setup or address position of FIG. 1, the handle 16 of the golf swing training aid 10 is positioned to extend rearward from the grip position of the golfer G and made to point directly towards the center of the golfer's torso, preferably at the belly button of the golfer or a belt buckle if worn. From the address position and through the initial takeaway of the golf club C that starts the backswing, the bowed guide arm 12 of the golf swing training aid 10 should remain firmly against the leading forearm, in this case, the left forearm of right-handed golfer G illustrated, and the handle 16 of the golf swing training aid 10 remain pointed at the golfer's belly button, as shown in FIG. 6*a*. A proper initial takeaway of the golf club C typically requires the club's head to be moved in a straight line rearward from its address position for a distance of approximately two feet and the described positioning of the guide arm 12 and handle 16 of the golf swing training aid 10 illustrated in FIG. 6*a* ensures the proper initial takeaway wherein the wrists remain quiet without hinging and the club's head is kept low to the ground while the upper torso of the golfer G begins rotation towards the rear. As the golf club C nears a waist high point in the backswing, shown in FIG. 6*b*, the wrists begin to hinge upward together and to ensure proper hinging motion without cupping or bowing of the leading wrist (here being the left wrist) of the golfer G, the guide arm 12 remains firmly against the leading forearm, indicated by the bold-face arrow in FIG. 6*b*. As the golf club C is brought to the top of the backswing, shown in FIG. 6*c*, the position of the guide arm 12 is maintained firmly against the leading forearm, as indicated by the bold-face arrow in FIG. 6*c*. Maintaining this positioning of the guide arm 12 firmly against the leading forearm will ensure that the back of the leading wrist remains flat throughout the entire backswing, indicated by the bold-face lines in FIGS. 6*b* and 6*c*, and serve to keep the golf club C on the proper swing plane.

Figure 6D:
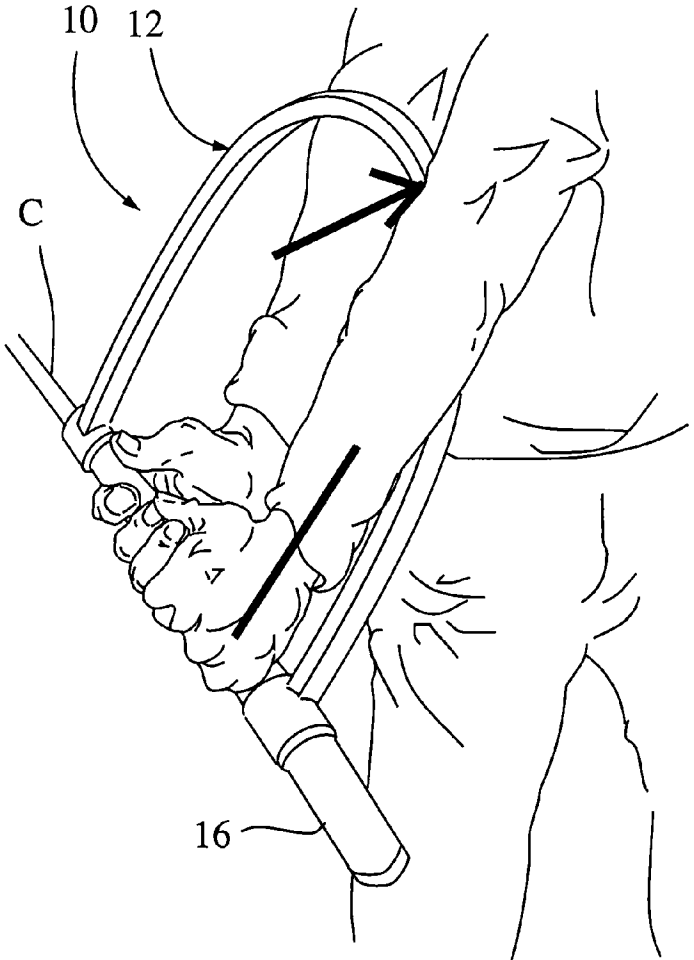
Figure 6C:
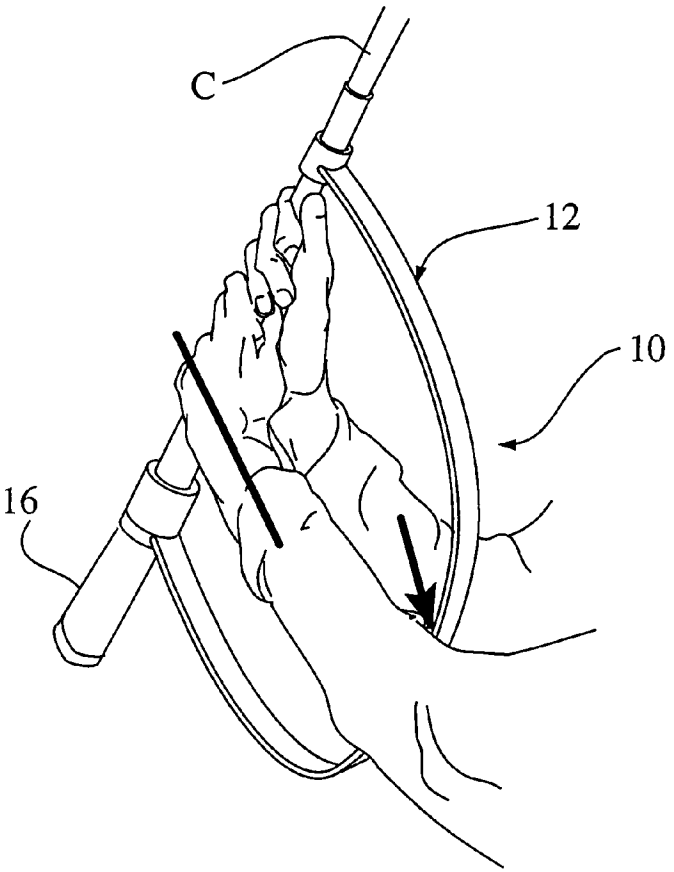
Figure 6F:
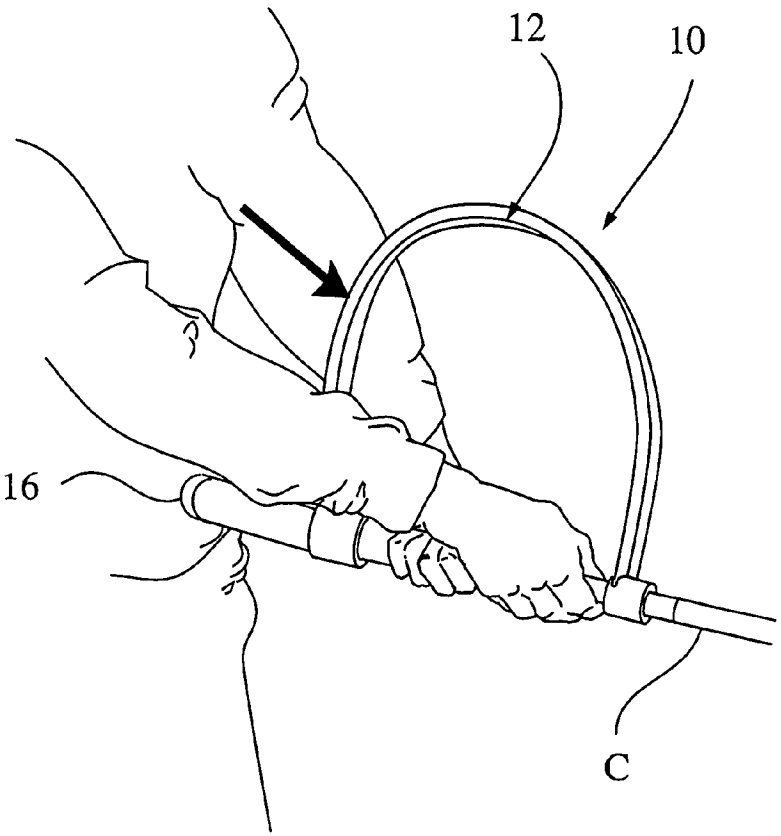
Figure 6E:
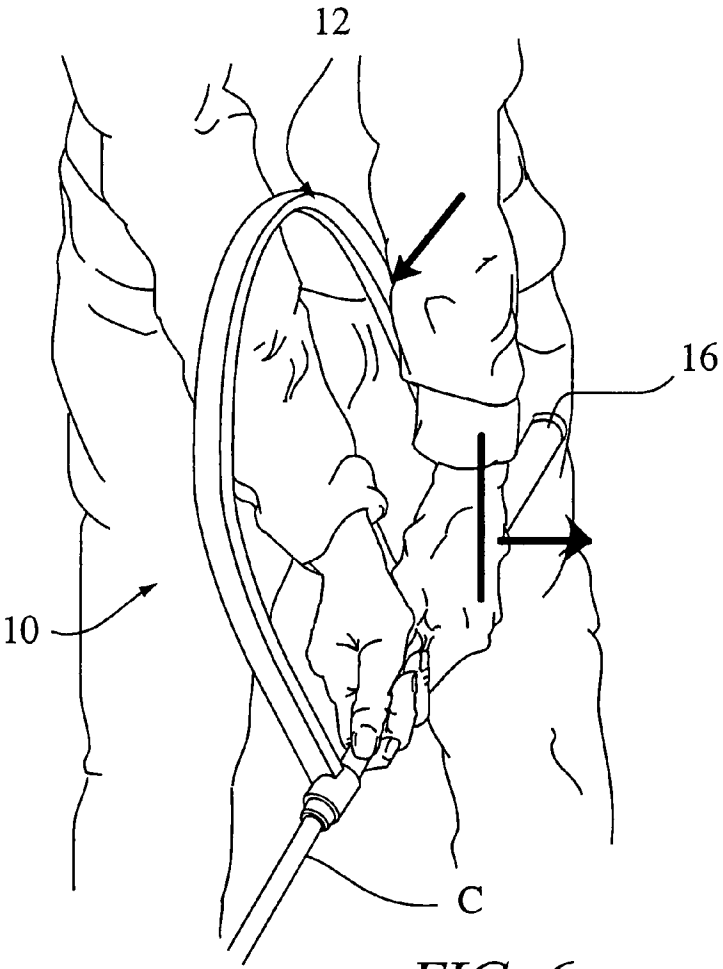

The forward swing or downswing of the golf club C starts from the top of the backswing by dropping the butt end of the handle 16 of the golf swing training aid 10 in a downward motion pointing toward the ground and substantially along the target line while continuing to keep the bowed guide arm 12 in constant contact with the leading forearm, as shown by the bold-face arrow in FIG. 6*d*. Unhinging of the wrists during the forward swing is generally to be delayed until the hands are below the waist of the golfer G and as indicated by the bold-face line in FIG. 6*d*, maintaining the contact position between the guide arm 12 and the leading forearm ensures that proper unhinging of the wrists occurs with the back of the leading wrist flat and pointing down the target line. As the hands pass through the impact zone in the forward swing, shown in FIG. 6*e*, the lower and upper are uncoiling and the guide arm 12 of the golf swing training aid 10 remains in contact with the leading forearm to ensure that the back of the leading wrist remains flat and moving down the target line at impact, as indicated by the bold-face lines and arrows in FIG. 6*e*. This relative positioning of the hands and arms of the golfer G with the hands just ahead of the ball at impact is encouraged and developed by the present golf swing training aid 10 and will result in greater club head speed at impact and greater ball distance on full swing shots as well as better struck chip shots. In completing the forward swing and follow-through of the golf club C using the golf swing training aid 10, as shown in FIG. 6*f*, the contact of the guide arm 12 maintained with the leading forearm all the way to the finish of the swing together with the uncoiling of the lower and upper body of the golfer G will ensure a free and complete release of the golf club C that improves the golfer's shot making performance.

Therefore, it is apparent that the described invention provides an improved golf swing training aid capable of enhancing the playing performance of golfers of all sorts through practice usage. More particularly, the present invention provides a golf swing training aid capable of releasable attachment to any golf club, be it right-handed or left-handed, and usable in practice by a golfer, male or female, without restricting or interfering with his or her swing motion to teach proper swing movements of the hands and arms and correct positioning of the wrists during execution of a full swing. The present invention also provides a swing training aid for practice use by right-handed and left-handed golfers that is readily attached to the golf club and capable of remaining firmly positioned in proper placement thereon during extended practice and repeated swing usage. The present golf swing training aid affords immediate feedback to the golfer during practice usage and enhances the development of associated muscle memory learned therefrom in order to promote a correct takeaway and proper hinging and unhinging of the wrists throughout the swing. In addition, the present golf swing practice aid trains the golfer to maintain the flat position of the leading wrist and forearm at the top of the backswing and down through impact and prevent unnecessary cupping or bowing of the lead wrist. The present swing training aid is lightweight yet durable in its construction, simple in its assembly and attachment, and capable of effective use at home as well as on the practice range by all golfers regardless of their skill level.

Obviously, other embodiments and modifications of the present invention will readily come to those or ordinary skill in the art having the benefit of the teachings presented in the foregoing description and drawings. Alternate embodiments of different shapes and sizes, as well as substitution of known materials or those materials that may be developed at a future time to perform the same function as the present described embodiment are therefore considered to be part of the present invention. Accordingly, it is understood that this invention is not limited to the particular embodiment described, but rather is intended to cover modifications within the spirit and scope of the present invention as expressed in the appended claims.

What is claimed is:

1. A golf swing training aid intended for practice use by a golfer as a removable attachment to a golf club of the type having a grip with an outer end and inner end attached to a shaft along the longitudinal axis of the club, comprising:

clamp means for releasably attaching to the outer end of the grip along the longitudinal axis of the golf club;

a handle member operatively connected to said clamp, means and extending rearwardly therefrom in the direction of the longitudinal axis of the golf club when said clamp means is attached to the grip; and a guide arm member having a length bowed in configuration, said guide arm member being connected at one end thereof to said clamp means and extending forwardly therefrom to a distal end formed to releasably engage the inner end of the grip so that said guide arm member is positioned to project over the grip and maintained between the forearms of the golfer along the longitudinal axis of the golf club when said clamp means are attached to the outer end of the grip and the hands of the golfer are positioned normally upon the grip during practice use by the golfer.

2. A golf swing training aid according to claim 1, wherein said clamp means comprises:

a collar housing having an open front end and a chamber therein fitted to contain the outer end of the grip; and a plurality of finger members assembled in a radial arrangement and adapted to move in an axial direction within the chamber of said collar housing to selectively engage and release the outer end of the grip.

3. A golf swing training aid according to claim 2, wherein said plurality of finger members are each made in a flexible form having a rounded head section at the top and a stem section depending therefrom.

4. A golf swing training aid according to claim 3, wherein the chamber of said collar housing is tapered to fit the assembled plurality of finger members and adapted to interact therewith as the assembled finger members move within the chamber to selectively close and open the radial arrangement.

5. A golf swing training aid according to claim 4, wherein said clamp means further comprises:

guide means fitted to the chamber of said collar housing for guiding the axial movement of the assembled finger members therethrough.

6. A golf swing training aid according to claim 2, wherein said handle member is coupled to said collar housing and adapted to extend rearwardly therefrom in an axial direction substantially aligned with the longitudinal axis of the golf club when fully engaged by the plurality of finger members to provide a visual guide to the golfer.

7. A golf swing training aid according to claim 6, wherein said handle member is made visually distinctive to contrast in appearance with said clamp means and said guide arm member.

8. A golf swing training aid according to claim 7, wherein said handle member is operatively connected to said collar housing for selectively locking and releasing the engagement of the plurality of finger members on the outer end of the grip.

9. A golf swing training aid according to claim 1, wherein said guide arm member comprises a U-shaped frame connected at one end to said clamp means and having a clip member at the opposite end thereof to engage the inner end of the grip.

10. A golf swing training aid according to claim 9, wherein said clip member is formed having a C-shaped configuration centered in position on the U-shaped frame to engage the inner end of the grip substantially along the longitudinal axis of the golf club.

11. A golf swing training aid intended for practice use by a golfer as a removable attachment to a golf club of the type having a grip with an outer end and inner end attached to a shaft along its longitudinal axis, comprising:

a clamp assembly for releasably engaging the outer end of the grip in substantial alignment with the longitudinal axis of the golf club;

a handle member operatively connected to said clamp assembly and rearwardly extending therefrom so that said handle member projects in an axial direction substantially aligned with the longitudinal axis of the golf club when engaged by said clamp assembly; and a guide arm member operatively connected at one end thereof to said clamp assembly and made to extend forwardly therefrom, said guide arm member comprising a U-shaped frame connected at one end to said clamp means and having a clip member at the opposite end thereof to engage the inner end of the grip so that said guide arm member is maintained in a position projecting over the grip along the longitudinal axis of the golf club and between the forearms of the golfer during practice use.

12. A golf swing training aid according to claim 11, wherein said clamp assembly comprises:

a collar housing having an open front end and a chamber therein fitted to contain the outer end of the grip; and an assembly of finger members mounted in a radial arrangement and adapted to move together in an axial direction within the chamber of said collar housing to selectively engage and release the grip end of the golf club.

13. A golf swing training aid according to claim 12, wherein the chamber of said collar housing is tapered to selectively close and open said assembly of finger members as said assembly moves back and forth within said collar housing.

14. A golf swing training aid according to claim 13 wherein each of said finger members in said assembly is formed having a rounded head section at the top and a stem section depending therefrom.

15. A golf swing training aid according to claim 14 wherein said assembly of finger members further comprises:

holder means for maintaining said radial arrangement of the finger members as said assembly moves axially within the chamber of said collar housing.

16. A golf swing training aid according to claim 12, wherein said clamp assembly further comprises:

guide means fitted to the chamber of said collar housing for guiding the axial movement of the assembled finger members therethrough.

17. A golf swing training aid according to claim 12, wherein said handle member is operatively connected to said collar housing for selectively locking and releasing the engagement of the assembly of finger members on the outer end of the grip.

* * * * *